United States Patent [19]

Reed, Jr. et al.

[11] Patent Number: 4,601,344

[45] Date of Patent: Jul. 22, 1986

[54] PYROTECHNIC FIRE EXTINGUISHING METHOD

[75] Inventors: Russell Reed, Jr.; May L. Chan, both of Ridgecrest, Calif.; Kenneth L. Moore, Cabin John, Md.

[73] Assignee: The United States of America as represented by the Secretary of the Navy, Washington, D.C.

[21] Appl. No.: 548,899

[22] Filed: Sep. 29, 1983

[51] Int. Cl.[4] ..... C06B 45/10

[52] U.S. Cl. ..... 169/47; 102/531; 149/19.6; 252/4

[58] Field of Search ..... 252/4; 169/47, 44; 149/19.6; 102/531

[56] References Cited

U.S. PATENT DOCUMENTS

| | | | |
|---|---|---|---|
| 3,354,172 | 11/1967 | Takacs | 260/308 |
| 3,641,935 | 2/1972 | Gawlick et al. | 102/531 |
| 3,690,695 | 9/1972 | Jones | 280/150 AB |
| 3,719,604 | 3/1973 | Prior et al. | 252/186 |
| 3,759,765 | 9/1973 | Young | 149/19.91 |
| 3,785,674 | 1/1974 | Poole et al. | 149/35 |
| 3,909,322 | 9/1975 | Chang et al. | 149/19.6 |
| 3,912,561 | 10/1975 | Doin et al. | 149/35 |
| 3,954,528 | 5/1976 | Chang et al. | 149/19.4 |
| 3,972,820 | 8/1976 | Filter et al. | 149/19.6 |
| 4,269,637 | 5/1981 | Flanagan | 149/19.6 X |
| 4,288,262 | 9/1981 | Flanagan et al. | 149/19.6 |

*Primary Examiner*—Edward A. Miller

*Attorney, Agent, or Firm*—Robert F. Beers; W. Thom Skeer

[57] ABSTRACT

A gas generating composition containing glycidyl azide polymer and a high nitrogen content additive selected from the group consisting of guanylaminotetrazole nitrate, bis(triaminoguanidinium)5,5'azotetrazole, ammonium 5-nitraminotetrazole and high bulk density nitro guanidine generates large quantities of nitrogen gas upon burning and can be used to extinguish fires.

6 Claims, No Drawings

PYROTECHNIC FIRE EXTINGUISHING METHOD

BACKGROUND OF THE INVENTION

Field of the Invention:

This invention relates to gas generating systems. More particularly, this invention relates to gas generating compositions which release large amounts of nitrogen gas to suppress fires.

Description of the Prior Art:

A common fire extinguisher for small localized fires is bottled carbon dioxide gas. This carbon dioxide system has several disadvantages. The storage bottles must withstand high pressures and the possibility of leakage requires periodic checking of the pressure and weight to insure that adequate amounts of carbon dioxide remain in the bottles. A system is desired that does not require constant monitoring or checking.

SUMMARY OF THE INVENTION

Accordingly, the present invention provides gas generating compositions comprising glycidyl azide polymer (GAP and a high nitrogen content solid additive selected from the group consisting of guanylaminotetrazole nitrate, bis(triaminoguanidium) 5,5'-azotetrazole, ammonium 5-nitraminotetrazole and high bulk density nitroguanidine.

OBJECTS OF THE INVENTION

It is an object of this invention to provide solid gas generating compositions which generate large amounts of nitrogen gas when the compositions are burned.

Another object of this invention is to provide a method of extinguishing a fire by providing gas generating compositions which generate large amounts of nitrogen gas to extinguish a fire.

Still another object of this invention is to provide gas generating compositions that generate large amounts of nitrogen gas when brought in contact with a fire to extinguish the fire.

Yet another object of this invention is to provide gas generating compositions which can be cast cured into small shapes and stored in a conveniently located container as a fire extinguisher.

These and other objects and novel features of the invention will become apparent from the following detailed description.

DETAILED DESCRIPTION OF THE INVENTION

It has been found that compositions containing glycidyl azide polymer (GAP) and a high nitrogen content solid additive or compound will generate substantially large amounts of nitrogen gas when brought into contact with a fire. This production of nitrogen gas can be used to smother or extinguish the fire. The high nitrogen content solid additives used include guanylaminotetrazole nitrate (GATN), bis(-triaminoguanidinium) 5,5'-azotetrazole (BTAGAZT), ammonium 5-nitraminotetrazole (ANT) and high bulk density nitroguanidine (HNBQ).

The following examples will serve to illustrate this invention without restricting it to what is specifically described.

EXAMPLE I

A preferred nitrogen gas generating composition was prepared including the following ingredients:

| | |
|---|---|
| glycidyl azide polymer (GAP) | 4.26 weight percent; |
| the biuret trimer of hexamethylene diisocyanate (N-100) | 0.74 weight percent; |
| (BTAGAZT) | 95.0 weight percent; and |
| dibutyltin dilaurate | 0.005 weight percent. |

The ingredients were thoroughly mixed and warmed to 130° F., then pressed into various sized granules and tablets and cooled. A uniform mixture is obtained by using a solvent such as methylene chloride during mixing and then removing the solvent. The tablets when heated, decomposed and evolved 80 g of nitrogen gas per 100 g of tablets.

EXAMPLE II

Another nitrogen gas generating composition was prepared in a similar fashion including the following ingredients:

| | |
|---|---|
| GAP | 42.6 weight percent; |
| N-100 | 7.4 weight percent; |
| BTAGAZT | 50.0 weight percent; and |
| dibutyltin dilaurate | 0.005 weight percent. |

The tablets prepared from this composition evolved 62 g of nitrogen gas per 100 g of tablets when heated.

EXAMPLE III

Another gas generating composition contained the following ingredients:

| | |
|---|---|
| GAP | 17.0 weight percent; |
| N-100 | 3.0 weight percent; |
| BTAGAZT | 80.0 weight percent; and |
| dibutyltin dilaurate | 0.005 weight percent. |

These ingredients were mixed together, poured into a gas generator cannister and cured at 130° F. for about 1 to 5 days. This composition has been calculated to generate 73 g of nitrogen per 100 g of composition.

The burn rates of compositions containing 50 weight percent GAP and 50 weight percent of the different high nitrogen content solid additives have been determined. The burn rates were measured at 70° F. and at 500 psi. The burn rate determines the amount of gas to be generated in a specific time period. In the case of a fire the time period may be limited and a fast burn rate is needed.

| ADDITIVE | BURN RATE |
|---|---|
| HBNQ | 0.193 in./sec. |
| GATN | 0.29 in./sec. |
| ANT | 0.73 in./sec. |
| BTAGAZT | 0.87 in./sec. |

The compositions of the invention are useful in extinguishing fires which are confined in an area not easily accessable and in operations where the occurance of fires is predictable. The occurance of such potential fires could be avoided by providing the smothering gas before the fire has a chance to ignite. Examples of operations with potential but predictable fires are plane crashes and oil refineries.

A method of combatting fires or preventing potential fires from occuring includes a fire extinguishing reservoir containing a gas generating composition. The gas generating composition can consist of pellets or tablets or the composition can be cast cured into a suitable reservoir or container in a similar fashion as a rocket motor is cast. The reservoir or container includes a device to ignite the composition. After the ignition of the gas generating composition, the evolved gas can be conveyed to the fire or potential fire site. The gas is expelled from appropriate pipes or ducts with fins to additionally cool the gas. The use of fins to cause cooling is well understood to those skilled in the art.

Obviously many modifications and variations of the present invention are possible in light of the above teachings. It should be understood that within the scope of the appended claims the invention may be practiced otherwise than as specifically described.

What is claimed is:

1. A method of extinguishing a fire comprising the steps of:

providing a gas generating composition comprises glycidyl azide polymer and a high nitrogen content additive selected from the group consisting of guanylaminotetrazole nitrate, bis(-triaminoguanidium) 5,5'-azotetrazole, ammonium 5-nitraminotetrazole and high bulk density nitro guanidine in a reservoir;

igniting said composition to generate nitrogen gas; and conveying said nitrogen gas from said reservoir to said fire.

2. A method of extinguishing a fire according to claim 1 wherein said high nitrogen content additive is guanylaminotetrazole nitrate.

3. A method of extinguishing a fire according to claim 1 wherein said high nitrogen content is ammonium 5-nitraminotetrazole.

4. A method of extinguishing a fire according to claim 1 wherein said high nitrogen content additive is high bulk density nitro guanidine.

5. A method of extinguishing a fire according to claim 1 wherein said high nitrogen content additive is bis(triaminoguanidinium) 5,5'-azotetrazole.

6. A method of extinguishing a fire according to claim 1 wherein said composition comprises about 5 to 50 weight percent glycidyl azide polymer and 50 to 95 weight percent additive.

* * * * *